US005730303A

United States Patent [19]

Chow

[11] Patent Number: 5,730,303

[45] Date of Patent: Mar. 24, 1998

[54] HAND TOOL RACK

[75] Inventor: Jessie Chow, Taichung, Taiwan

[73] Assignee: Hand Tool Design Corporation, Washington, D.C.

[21] Appl. No.: 713,453

[22] Filed: Sep. 13, 1996

[51] Int. Cl.[6] ..... A47F 7/00; B65D 85/20

[52] U.S. Cl. ..... 211/70.6; 211/4; 206/372; 206/376; 294/161

[58] Field of Search ..... 211/70.6, 87.01, 211/4; 206/372, 375, 376, 377, 379, 526; 294/159, 161, 166; 312/902

[56] References Cited

U.S. PATENT DOCUMENTS

| | | | |
|---|---|---|---|
| 2,119,217 | 5/1938 | Rocchi | 211/70.6 X |
| 3,370,696 | 2/1968 | Groe | 294/161 |
| 3,837,477 | 9/1974 | Boudreau | 211/70.6 X |
| 4,911,297 | 3/1990 | Suburu | 206/372 X |
| 5,020,666 | 4/1991 | Barlean | 206/376 |
| 5,036,975 | 8/1991 | Chow | 206/376 |
| 5,346,063 | 9/1994 | Chow | 211/70.6 X |
| 5,346,677 | 9/1994 | Risk | 211/4 X |
| 5,505,316 | 4/1996 | Lee | 211/70.6 |
| 5,598,924 | 2/1997 | McCann | 211/70.6 X |
| 5,638,964 | 6/1997 | Ernst | 211/70.6 |

FOREIGN PATENT DOCUMENTS

| | | | |
|---|---|---|---|
| 598385 | 5/1960 | Canada | 211/70.6 |

*Primary Examiner*—Jose V. Chen
*Assistant Examiner*—James O. Hansen
*Attorney, Agent, or Firm*—Lowe, Price, LeBlanc & Becker

[57] ABSTRACT

A hand tool rack includes a first end adapted to be hung up to a wall, a second end, and a planar base between the first end and the second end. A stop is formed on the planar base adjacent to the first end of the hand tool rack. First and second fixing blocks are formed on the planar base and respectively adjacent to first and second lateral sides of the rack. A plurality of laterally equi-spaced mediate fixing blocks, holding members, and posts are mounted on the planar base and between the first and second fixing blocks. Each mediate fixing block is in alignment with an associated holding member and an associated post. Each holding member includes a protrusion projecting from an upper portion of a vertical wall thereof.

4 Claims, 4 Drawing Sheets

HAND TOOL RACK

BACKGROUND OF THE INVENTION

1. Field of the Invention

The present invention relates to a hand tool rack and, more particularly, to a hand tool rack which may provide a display function for retailers and prevent the tools on the hand tool rack from being stolen by dishonest customers.

2. Description of the Related Art

Hand tools are widely used in daily life and are often packaged in a tool box or tool rack for display purpose for retail. To prevent the hand tools from being stolen by dishonest customers, the hand tools are generally completely packaged, i.e., the customers cannot handle the hand tools to assure themselves of the quality thereof. Instead, only a picture or photograph illustrating the hand tools is attached to an outer side of the package. However, the customers often find they have bought the wrong products after unsealing the package at home as they cannot touch the hand tools to assure the material thereof. In addition, the tool racks on the present market are manufactured by blowing formation method, wherein the hand tools cannot be securely held by such tool racks as they merely provide two protrusions to hold each one hand tool and as the elasticity thereof is too low to provide the required holding effect.

The present invention is intended to provide an improved hand tool rack which mitigates and/or obviates the above problems.

SUMMARY OF THE INVENTION

A hand tool rack in accordance with the present invention generally includes a first end adapted to be hung up to a wall, a second end, a planar base between the first end and the second end, a first lateral side, and a second lateral side. A stop is formed on the planar base adjacent to the first end of the hand tool rack. First and second fixing blocks are formed on the planar base and respectively adjacent to the first and second lateral sides of the rack.

A plurality of laterally equally spaced mediate fixing blocks, holding members, and posts are mounted on the planar base and between the first and second fixing blocks. Each mediate fixing block is in alignment with an associated holding member and an associated post. Each holding member includes a protrusion projecting from an upper portion of a vertical wall thereof.

Each holding member further includes an L-shaped member at a top thereof, the L-shaped member having a first slot defined therein. Preferably, each of the first and second fixing blocks also include a second slot defined therein in alignment with the first slots of the L-shaped members. A latch member is extended through the slots of L-shaped members and the second slots of the first and second fixing blocks to prevent unauthorized removal of hand tools.

A plurality of laterally equi-spaced hooks are mounted on the planar base and adjacent to the second end of the hand tool rack. Each hook is in alignment with an associated post, and each two adjacent hooks having a compartment defined therebetween for receiving a shank of a hand tool. Preferably, the fixing blocks, the holding members, the posts, and the hooks are all made of elastic plastic material.

Other objects, advantages, and novel features of the invention will become more apparent from the following detailed description when taken in conjunction with the accompanying drawings.

DESCRIPTION OF THE PREFERRED EMBODIMENTS

Figures 1, 2:
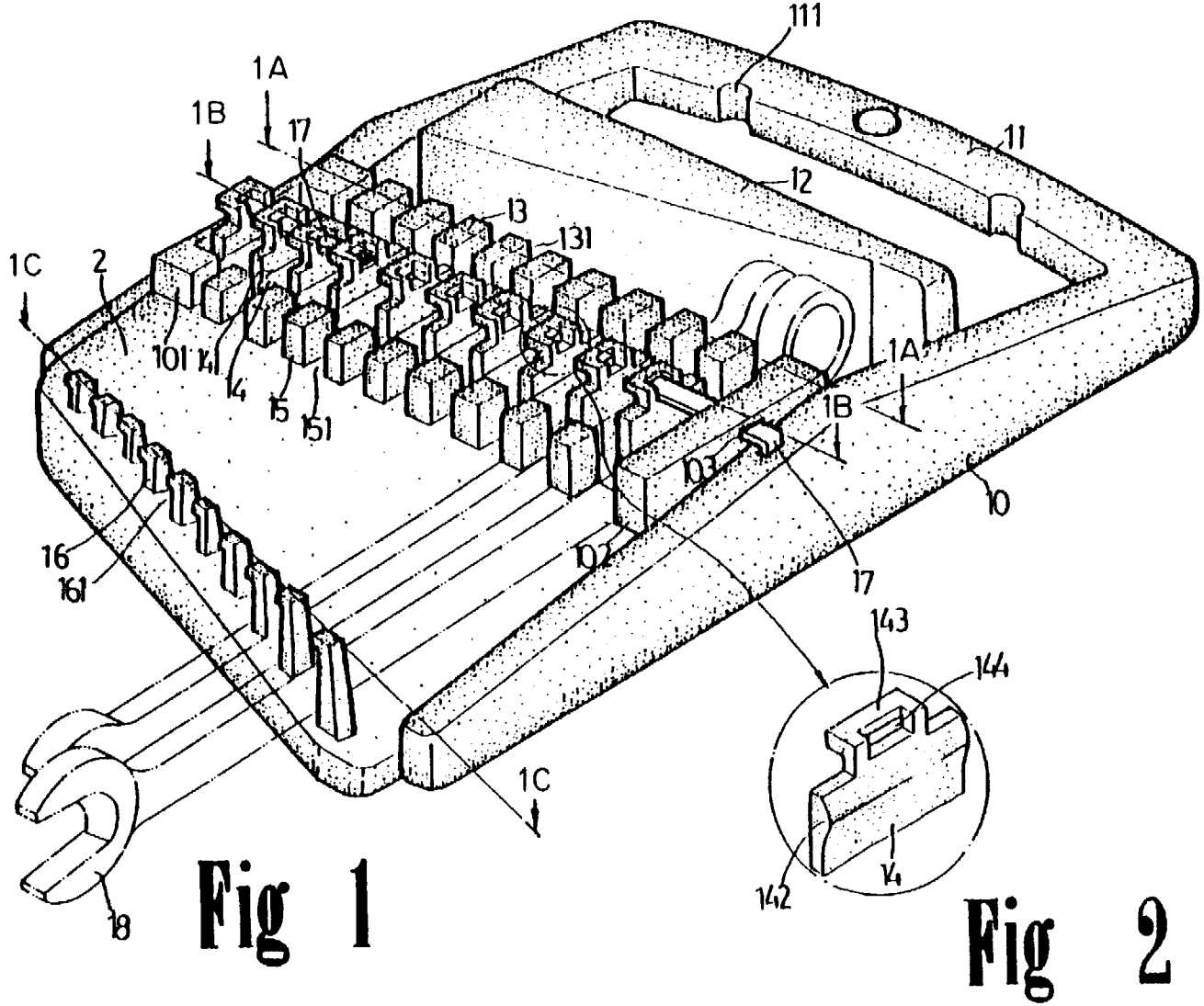
FIG. 1 is a perspective view of a hand tool rack in accordance with the present invention.
FIG. 2 is an enlarged view of a circle in FIG. 1.

Referring to the drawings and initially to FIGS. 1, 1A, 1B, and 1C, a hand tool rack 10 in accordance with the present invention is generally rectangular and includes a first end 11 with two notches 111 defined therein so as to be hung on a wall, if desired. Adjacent to the first end 11 of the rack 10, a stop 12 is formed on a planar base 2 of the rack 10 and has a first side (opposite to the first end 11 of the rack 10) which preferably inclines from a first lateral side to a second lateral side of the rack 10.

First and second fixing blocks 101 and 102 are formed on the planar base 2 and respectively adjacent to the first and second lateral sides of the rack 10. A plurality of laterally equi-spaced mediate fixing blocks 13, holding members 14, and posts 15 are mounted on the planar base 2 and between the first and second fixing blocks 101 and 102, wherein each one mediate fixing block 13 is in alignment with an associated holding member 14 and an associated post 15. Each two adjacent mediate fixing blocks 13 have a first compartment 131 defined therebetween, each two adjacent holding members 14 have a second compartment 141 defined therebetween, and each two adjacent posts 15 have a third compartment 151 defined therebetween.

As can be seen in FIG. 1, each mediate fixing block 13 is mounted adjacent to the stop 12 and has a compartment therebetween. As shown in FIGS. 2 and 1B, each holding member 14 includes a protrusion 142 projecting from an upper portion of a vertical wall thereof. Each holding member 14 may further include an L-shaped member 143 at a top thereof, the L-shaped member 143 having a slot 144 defined therein, which will be described later. Adjacent to a second end of the rack 10, a plurality of equally laterally spaced hooks 16 are mounted on the planar base 2, wherein each hook 16 is in alignment with an associated post 15, and each two adjacent hooks 16 has a fourth compartment 161 defined therebetween. Preferably, the fixing blocks 13, the holding members 14, the posts 15, and the hooks 16 are all made of elastic plastic material.

Figure 1A:
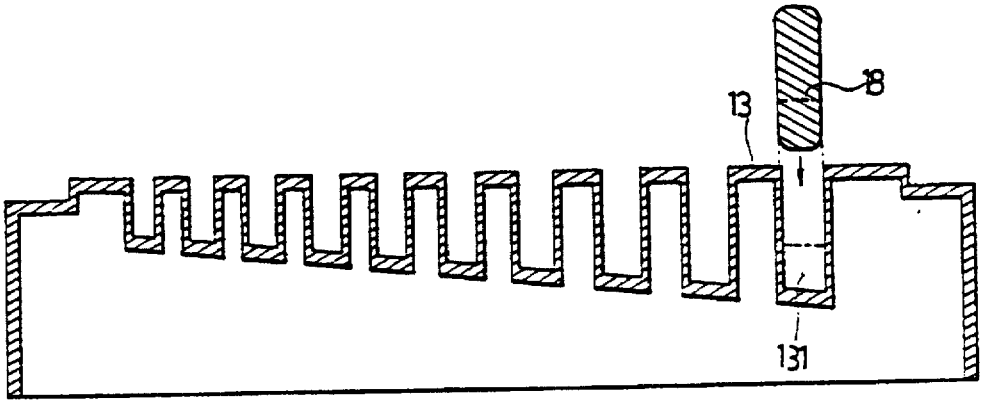
FIG. 1A is a cross-sectional view taken along line 1A—1A in FIG. 1.
Figure 1B:
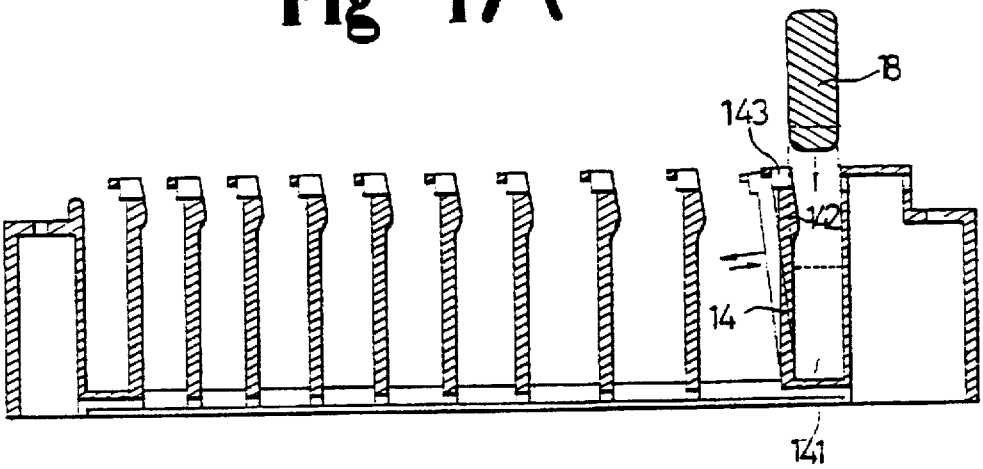
FIG. 1B is a cross-sectional view taken along line 1B—1B in FIG. 1.
Figure 1C:
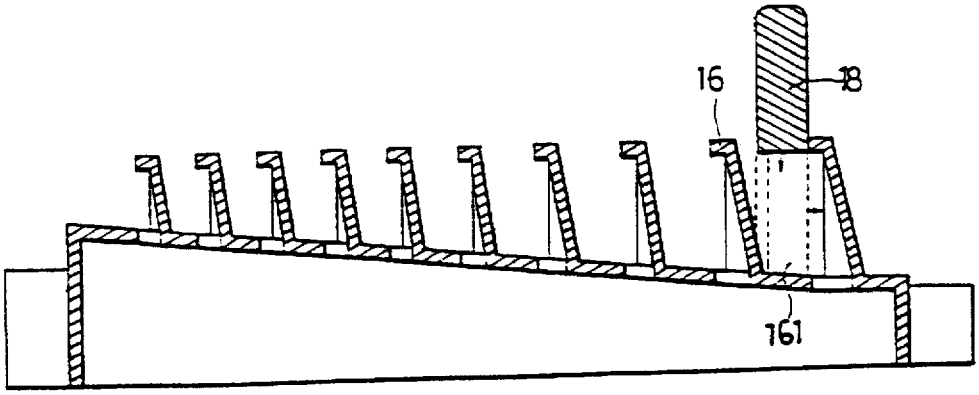
FIG. 1C is a cross-sectional view taken along line 1C—1C in FIG. 1.

In use, a spanner, e.g., a combination wrench 18 is inserted into one of the first compartments 131 defined between, e.g., the second fixing block 102 and the adjacent mediate fixing block 13, as shown in FIG. 1A. A first end of the combination wrench 18 is fittingly received between the stop 12 and the mediate fixing block 13 (see FIG. 1). Then, a shank of the combination wrench 18 is inserted into an associated second compartment 141 in alignment with the above-mentioned first compartment 131 (see Fig. 1B). It is appreciated that the holding member 14 is inclined leftwardly toward its adjacent holding member 14 when the shank of the combination wrench 18 is passing through the protrusion 142 thereof, the holding member 14, then, moves back to its initial position, thereby securely holding the shank of the combination wrench 18 in the second compartment 141 between the holding member 14 and the second end block 102. The other portion of the shank of the combination wrench 18 is, thereafter, inserted into the associated third compartment 161 (see FIG. 1C), while the shank further extends through the associated fourth compartment 161, with a second end of the combination wrench 18 beyond the rack 10. Nevertheless, it is appreciated that the combination wrench 18 can also be held between two adjacent holding members 14 or between the first fixing block 101 and the adjacent holding member 14

Figure 3:
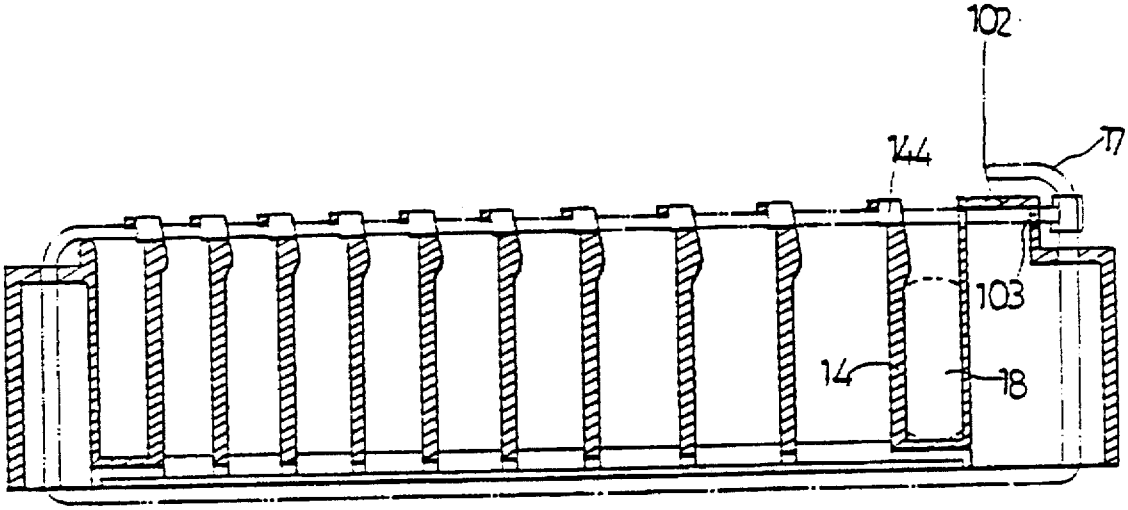
FIG. 3 is a cross-sectional view similar to FIG. 1B, wherein an additional latch member is used to prevent from unauthorized removal of hand tools on the hand tool rack.

Referring to FIG. 3, an additional latch member 17, e.g., a strap, may be extended through the slot 144 defined in the L-shaped member 143 on top of each holding member 14 and through a slot 103 defined in the second fixing block 102 and a slot (not labeled) defined in the first fixing blocks 101, thereby fixing the wrenches 18 in position. In other words, the wrenches 18 are not readily accessible for the dishonest customers.

Since the fixing blocks 13, the holding members 14, the posts 15, and the hooks 16 are all made of elastic plastic material, hand tools of different dimension units (e.g., imperial and metric)

Figure 4:
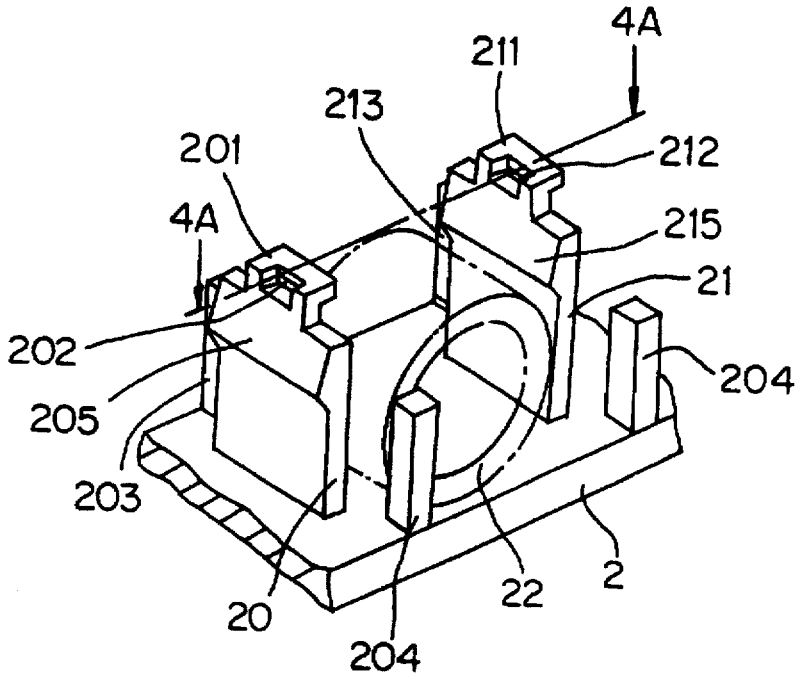
FIG. 4 is a perspective view illustrating a second embodiment of the present invention for holding sockets for operation with a socket wrench.
Figure 4A:
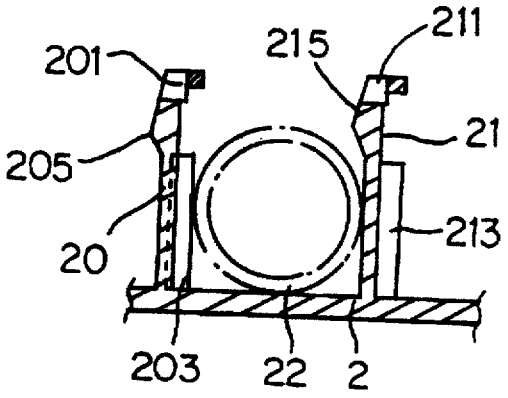
FIG. 4A is a cross-sectional view taken along line A—A in FIG. 4.

FIGS. 4 and 5 illustrate a modified embodiment of the hand tool rack of the present invention for receiving sockets. The planar base 2 of the rack 10 may merely include a plurality of spaced holding members 20 and 21 (only two of them are shown), wherein each holding member 20, 21 includes a protrusion 205, 215 projecting from an upper portion of a vertical wall thereof. Each holding member 20, 21 further includes an L-shaped member 201, 211 at a top thereof, the L-shaped member 201, 211 having a slot 202, 212 defined therein. Four posts 203, 213, and 204 are respectively mounted adjacent to front and rear ends of two adjacent holding members 20 and 21. In use, a socket 22 is received between two adjacent holding members 20 and 21 and bears against at least two of the four posts 203, 213, and 204. Again, a strap (not shown) may be extended through the slots 202 and 212 to prevent the sockets from being stolen by dishonest customers.

According to the above description, it is appreciated that the present hand tool rack includes several advantages as follows:

1. The hand tool rack may be hung on a wall for display purpose in retail or for convenient use for users. The customers may handle the hand tools, thereby increasing the purchasing will of the customers.
2. The hand tools on the hand tool rack are secured in position by, e.g., a strap, thereby eliminating the possibility of being stolen. Yet, the buyer may cut off the strap to use the hand tool rack.
3. The hand tool rack of the present invention needs no additional plastic package or envelope, which is required in conventional designs.
4. Hand tools of different dimension units can be held by the present hand tool rack without modification. This provides more choice for customers and may largely reduce the manufacturing cost.
5. Sockets can also be held by the present hand tool rack by enlarging the distance between two adjacent holding members.

Although the invention has been explained in relation to its preferred embodiment, it is to be understood that many other possible modifications and variations can be made without departing from the spirit and scope of the invention as hereinafter claimed.

What is claimed is:

1. A hand tool rack, comprising:

a first end adapted to be hung up to a wall, a second end, a planar base between the first end and the second end, a first lateral side, and a second lateral side;

a stop formed on the planar base adjacent to the first end of the hand tool rack;

first and second fixing blocks formed on the planar base and respectively adjacent to the first and second lateral sides of the rack; and a plurality of laterally equi-spaced mediate fixing blocks, holding members, and posts mounted on the planar base and between the first and second fixing blocks, each said mediate fixing block being in alignment with an associated said holding member and an associated said post, each said holding member including a protrusion projecting from an upper portion of a vertical wall thereof, each said holding member further including an L-shaped member at a top thereof, the L-shaped member having a first slot defined therein, each of said first and second fixing blocks having a second slot defined therein in alignment with said first slots in said L-shaped members.

2. The hand tool rack according to claim 1, further comprising a latch member extending through the first slots of said L-shaped members and the second slots of the first and second fixing blocks.

3. The hand tool rack according to claim 2, further comprising a plurality of equally laterally spaced hooks mounted on the planar base and adjacent to the second end of the hand tool rack, each said hook being in alignment with an associated said post, and each two adjacent said hooks having a fourth compartment defined therebetween.

4. The hand tool rack according to claim 3, wherein the fixing blocks, the holding members, the posts, and the hooks are all made of elastic plastic material.

* * * * *